US005775735A

United States Patent [19]

Bolnick et al.

[11] Patent Number: 5,775,735

[45] Date of Patent: Jul. 7, 1998

[54] LABEL FORM FOR USE IN DRUG TESTING AND METHOD FOR APPLYING THE SAME

[76] Inventors: Martin M. Bolnick, 7161 Woodbridge Cir., Boca Raton, Fla. 33434; Richard S. Bolnick, 8 Spring Hollow, Roslyn, N.Y. 11576

[21] Appl. No.: 724,804

[22] Filed: Oct. 2, 1996

[51] Int. Cl.[6] ..... B42D 15/00

[52] U.S. Cl. ..... 283/81; 283/900; 283/105; 283/101

[58] Field of Search ..... 285/80, 79, 81, 285/101, 105, 900; 40/299, 310, 630

[56] References Cited

U.S. PATENT DOCUMENTS

| | | | |
|---|---|---|---|
| 4,918,604 | 4/1990 | Baum | 283/900 X |
| 4,932,682 | 6/1990 | Miller | 283/900 X |
| 4,976,351 | 12/1990 | Mangini et al. | 283/900 X |
| 5,048,870 | 9/1991 | Mangini et al. | 283/900 X |
| 5,071,168 | 12/1991 | Shamos | 283/900 X |
| 5,642,906 | 7/1997 | Foote et al. | 283/900 X |

*Primary Examiner*—Willmon Fridie, Jr.
*Attorney, Agent, or Firm*—Kenyon & Kenyon

[57] ABSTRACT

A multi-segment label set form especially for use in testing of drugs. One embodiment has a first label segment with a permanent adhesive backing layer and second and third label segments with temporary adhesive backing layers. The first and second label segments contain information to identify the patient participating in the test, the drug being tested, and other study information. The third label segment contains or can be marked to contain hidden information as to whether the particular patient has been prescribed a drug or a placebo. The hidden information is concealed by a cover portion of the third label segment which can be removed by the patient's physician in the event of medical emergency. The first and third label segments are cut with tamper evident slits. V-cut cusps or notches are disposed between the first and second label segments to facilitate removal of the second and third label segments from the first label segment. The label sets are detachably disposed and not attached to adjacent label sets on a label carrying sheet which is advanced to a label transfer station where the label sets are removed from the carrying sheet and applied to corresponding containers. The second and third label segments are later removed from the containers and applied manually to corresponding case report forms.

29 Claims, 10 Drawing Sheets

LABEL FORM FOR USE IN DRUG TESTING AND METHOD FOR APPLYING THE SAME

FIELD OF THE INVENTION

This invention relates to a multi-segment label set form adapted for use in the testing of drugs, especially on human and animal subjects, and an improved method for applying at least one segment of each label set of the form to a container and at least one other segment of the label set to a case report document.

BACKGROUND OF THE INVENTION

In the testing of drugs it is necessary to use control groups in order to determine the effects of the drug being tested. Some individuals in the test group are given the drug, while other individuals in the group may be given a placebo. Information as to a patient's medical condition while participating in the test is entered by their physician on a case report form. When the test is completed, the case report form is returned to the entity administering the test.

To prevent skewing of the test results due to the possibility of different treatment, neither the individuals participating in the test nor their physicians are told if the individual is taking the drug or a placebo.

However, since there is always the possibility of adverse effects from the drug, it is essential that each physician having a patient who participates in the test, have information readily available concerning what to do if the patient's condition deteriorates—in which case the physician must be able to readily determine whether the patient has been administered the drug or a placebo.

For these purposes a label set consisting of three label segments is currently in use. The first label segment contains information identifying the patient and directions for the test. The second label segment contains similar information. The third label segment has a covered sealed portion ("cover portion") and an underlying data portion, with the underlying data portion containing information indicating whether the patient has been given the drug or a placebo.

The exposed surface of the cover portion is designed so that it doesn't show writing or printing which appears on a layer beneath the cover portion. A tear-off overlying top sheet portion, which can be removed after writing or printing on it, is provided overlying the cover portion so that no printing shows on the exposed surface of the cover portion. The undersurface of the cover portion may be covered with a layer of imaging or transfer substance, for example "carbon" paper, so that writing or printing on the exposed surface of the cover portion, or the tear-off overlying top sheet portion overlying the cover portion, results in the printing being imprinted on the underlying data portion. This arrangement permits the entity administering the test to make appropriate notations which are hidden from view until the cover portion of the third segment is removed to expose the information imprinted on the underlying data portion.

The three-segment label set form (hereinafter "label set") currently in use is initially disposed on a label carrying sheet having a smooth, waxy type of surface. The three label segments of the label set are provided on their non-imprinted surfaces with a self-sticking permanent affixation adhesive. The label sets detachably adhere to the label carrying sheet and can be fed to a printer to imprint the desired indicia on the label sets.

After the label sets are imprinted by the printer, the second label segment and the attached third label segment remain attached to the first label segment and all three label segments are still attached to the carrying sheet. The adjacent label sets are then detached from each other. This is done by cutting, either manually or by machine, the carrying sheet that separates the label sets. Before the adjacent label sets can be detached from each other, the cover portions of adjacent label sets, which are attached in labels currently in use, must also be separated. When a label set has been separated from the adjacent label sets, the waxy carrying sheet still covers the permanent adhesive of all three segments. The portion of the waxy carrying sheet covering the permanent affixation adhesive of the first label segment is stripped off to expose the permanent adhesive on the first label segment and the first label segment is then permanently applied to a container which contains, or will contain, the drug to be tested or the placebo. The second and third label segments, which still have their permanent affixation adhesive covered by the waxy carrying sheet, are then manually wrapped around the container, possibly overlapping the first label segment, and are temporarily secured to the container by a temporary securing means such as a rubber band or a small piece of tape.

At the time the drug is dispensed, the temporary securing means for temporarily holding the second and third label segments in place on the container is removed and the second and third label segments are unwrapped from the container. The second and third label segments are then detached from the first label segment which is permanently attached to the container. The carrying sheet is then stripped off of the second label segment and the third label segment to expose the permanent affixation adhesive on the back of the second label segment and the third label segment. The second and third label segments are then permanently attached to a case report form for the patient participating in the test.

This is a tedious, time-consuming, and expensive process in most drug tests where hundreds and often thousands of patients can be involved and hundreds or thousands of containers are utilized.

Accordingly, an object of the present invention is to provide an improved label form for use in drug testing and a method for applying the same which is adaptable to automation.

SUMMARY AND OBJECTS OF THE INVENTION

According to one aspect of the present invention there is provided a three-segment label set form for use in drug testing. The form has an elongated label carrying sheet adapted for movement by a label applying apparatus in a longitudinal direction of the sheet. The label carrying sheet has a surface for detachably receiving label sets comprising label segments having self-adhering adhesive coatings thereon. A plurality of adjacent label sets are disposed longitudinally of each other on the label carrying sheet and are detachably adhered to the label carrying sheet. The adjacent label sets are not attached to one another so as to facilitate removal of the label sets from the label carrying sheet.

Each label set has three label segments. The first label segment has identifying indicia on one major surface and a permanent affixation adhesive layer on the opposite major surface. The second label segment is adjacent and detachably connected to the first label segment, and has identifying indicia on one major surface often corresponding to the identifying indicia of the first label segment, and a temporary affixation adhesive layer on the opposite major surface. The third label segment is adjacent to-and-permanently connected to the second label segment and has a removable cover portion and an underlying data portion having one major surface adapted to receive indicia respecting a drug test, the indicia being unreadable until the cover portion is removed. The third label segment has a temporary affixation adhesive layer on its opposite major surface.

According to another aspect of the present invention there is provided a method for applying label sets to corresponding containers so that a first label segment of each label set is applied to a container and a second and third label segment of said label set are applied to a corresponding case report document for drug testing purposes.

According to this method, a major surface of the first label segment of each label set is provided with a permanent affixation adhesive layer, and a major surface of the second and third label segments of each label set is provided with a temporary affixation adhesive layer. The first, second, and third label segments of each label set are detachably adhered to an elongated label carrying sheet.

The label carrying sheet is advanced, e.g., by a conventional track and feed device, in its longitudinal direction to a label transfer station. At the label transfer station, each label set is detached from the label carrying sheet. The first label segment of the label set is applied to a corresponding container to permanently adhere the first label segment to the container, and the second and third label segments of that label set are applied to the container to temporarily and detachably adhere the second and third label segments to the container. When the circumference of the container is equal to or greater than the length of the label set there will be no overlap of the first and third label segments. When the circumference of the container is less than the length of the label set, there will be some overlap of the label segments. The degree of overlap is inversely proportional to the circumference of the container.

In another embodiment of the invention, there is provided a three-segment label set form as discussed above except that the positions of the second label segment and the third label segment are reversed. The first label segment has identifying indicia on one major surface and a permanent affixation adhesive layer on the opposite major surface. The second label segment is adjacent and detachably connected to the first label segment, and has a removable cover portion and an underlying data portion having one major surface adapted to receive indicia, the indicia being unreadable until the cover portion is removed. The second label segment has a temporary affixation adhesive layer on its opposite major surface. The third label segment is adjacent to and permanently connected to the second label segment and has identifying indicia on one major surface often corresponding to the identifying indicia of the first label segment, and a temporary affixation adhesive layer on the opposite major surface.

In another embodiment of the invention, there is provided a two-segment label set form for use in drug testing. The first label segment has identifying indicia on one major surface and a permanent affixation adhesive layer on the opposite major surface. The second label segment is adjacent and detachably connected to the first label segment and has identifying indicia on one major surface often corresponding to the identifying indicia of the first label segment and a temporary affixation adhesive layer on the opposite major surface. The two-label segment can be used where it is not necessary to hide information, thus, a third label segment with the cover portion is not required.

It is another object of this invention to provide a multi-segment label form comprising: an elongated label carrying sheet said sheet having a non-stick surface for detachably receiving label sets comprising label segments having self-adhering adhesive coatings thereon; and a plurality of adjacent label sets disposed on said label carrying sheet and detachably adhered thereto without being attached to each other, each label set including a first label segment having a permanent affixation adhesive layer on a major surface, a second label segment adjacent and detachably attached to said first label segment, said second label segment having a permanent affixation adhesive layer on a major surface, and a mounting sheet having a first major surface and a second major surface, said second major surface provided with a temporary affixation adhesive layer, said first major surface of said mounting sheet attached to said permanent affixation adhesive on said second label segment, a third label segment adjacent and attached to said second label segment, said third label segment having a removable cover portion and an underlying data portion having one major surface adapted to receive indicia that is unreadable until said removable cover portion is removed, said data portion having a permanent affixation adhesive layer on its opposite major surface, a mounting sheet having a first major surface and a second major surface, said second major surface provided with a temporary affixation adhesive layer, said first major surface of said mounting sheet attached to said permanent affixation adhesive on said third label segment, a line of perforations between said first label segment and said second label segment to facilitate the detachment of said first label segment from said second label segment.

It is yet another object of this invention to provide a multi-segment label form for use in drug testing, comprising: an elongated label carrying sheet said sheet having a non-stick surface for detachably receiving label sets comprising label segments having self-adhering adhesive coatings thereon; and a plurality of adjacent label sets disposed on said label carrying sheet and detachably adhered thereto without being attached to each other, each label set including a first label segment having a permanent affixation adhesive layer on a major surface, a second label segment adjacent and detachably connected to said first label segment, said second label segment having a permanent affixation adhesive layer on a major surface, a mounting sheet having a first major surface and a second major surface, said second major surface provided with a temporary affixation adhesive layer, said first major surface of said mounting sheet attached to said permanent affixation adhesive on said second label segment, a line of perforations between said first label segment and said second label segment to facilitate the detachment of said first label segment from said second label segment.

It is a further object of this invention to provide a multi-segment label form for use in drug testing, comprising: an elongated label carrying sheet said sheet having a non-stick surface for detachably receiving label sets comprising label segments having self-adhering adhesive coatings thereon; and a plurality of adjacent label sets disposed on said label carrying sheet and detachably adhered thereto without being attached to each other, each label set including a first label segment having a permanent affixation adhesive layer on a major surface, a second label segment adjacent and detachably attached to said first label segment, said second label segment having a removable cover portion and an underlying data portion having one major surface adapted to receive indicia that is unreadable until said removable cover portion is removed, said data portion having a permanent affixation adhesive layer on the opposite major surface, a mounting sheet having a first major surface and a second major surface, said second major surface provided with a temporary affixation adhesive layer, said first major surface of said mounting sheet attached to said permanent affixation adhesive on said second label segment, a third label segment adjacent and attached to said second label segment, said third label segment having a permanent affixation adhesive layer on a major surface, a mounting sheet having a first major surface and a second major surface, said second major surface provided with a temporary affixation adhesive layer, said first major surface of said mounting sheet attached to said permanent affixation adhesive on said third label segment, a line of perforations between said first label segment and said second label segment to facilitate the detachment of said first label segment from said second label segment.

It is another object of this invention to provide a label form for use in drug testing, comprising: an elongated label carrying sheet said sheet having a non-stick surface for detachably receiving labels having self-adhering adhesive coatings thereon; and a plurality of adjacent labels disposed on said label carrying sheet and detachably adhered thereto without being attached to each other, each label including: a label having a permanent affixation adhesive layer on a major surface, a mounting sheet having a first major surface and a second major surface, said second major surface provided with a temporary affixation adhesive layer, said first major surface of said mounting sheet sized and attached to said permanent affixation adhesive on said label segment so as to cover less than the entire surface of said permanent affixation adhesive layer to leave a portion of said permanent affixation adhesive exposed.

DESCRIPTION OF PRIOR ART LABEL FORM

Figure 1:
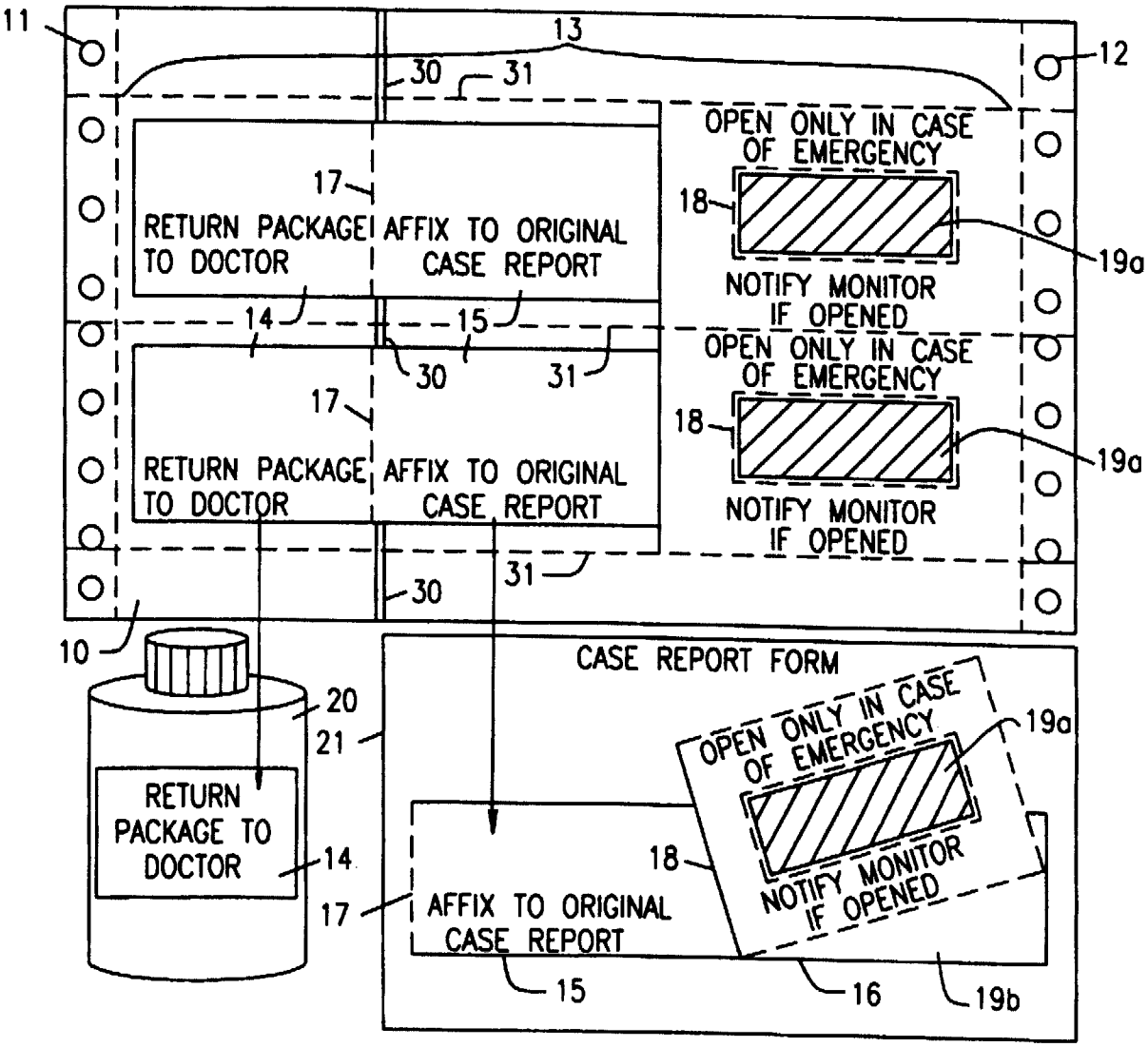
FIG. 1 (PRIOR ART)
FIG. 1 (prior art) shows a label set form for use in drug testing and a method for applying the same according to the prior art (all drawings are not to scale and some features have been exaggerated for illustration purposes)

FIG. 1 is a top view of a three-segment label set form according to the prior art and has an elongated label carrying sheet 10 with lines of sprocket holes 11 and 12 along its longitudinal sides for facilitating tractor feed of the carrying sheet 10. The label carrying sheet 10 has a smooth waxy type of surface to which the self-adhesive backed label sets 13 are detachably affixed. Perforations 31 may be provided to assist I in detaching adjacent label sets 13. Each label set 13 is comprised of a first label segment 14, a second label segment 15, and a third label segment 16. The first label segment 14 is detachably connected to second label segment 15. Perforations 17 may be provided to assist in detaching the first label segment 14 from the second label segment 15. Third label segment 16 is covered by removable cover portion 19*a*. Third label segment 16 is provided on one of its major surfaces with an underlying data portion 19*b* that is normally covered by cover portion 19*a*. Cover portion 19*a* is normally made of paper and is usually glued at its periphery to the third label segment 16, thus, covering underlying data portion 19*b*. The removable cover portion 19*a* is provided with an outline or guide 18 in which information is to be entered. When used as intended, first label segment 14 will be permanently attached to a container 20 and the second label segment 15 and the third label segment 16 will be permanently attached to a case report form 21. The covering portions 19*a* of adjacent label sets 13 are connected to each other and must also be disconnected when detaching adjacent label sets 13. After a label set 13 is detached from adjacent label sets 13, carrying sheet 10 under the first label segment 14 is detached from the first label segment 14. A cut 30 is made in carrying sheet 10 to facilitate removal of the carrying sheet 10 from the first label segment 14 while leaving the carrying sheet 10 intact under the second label segment 15 and third label segment 16. The first label segment 14, with the second and third label segments 15 and 16 still attached to it, is then permanently attached to a container 20. The second label segment 15 and third label segment 16, with their permanent affixation adhesive still covered by the waxy carrying sheet 10, are wrapped around the container 20 and temporarily held in place by a temporary securing means, such as a rubber band or a piece of tape, until they are detached from the first segment 14 and permanently attached to a case report form 21.

Figure 2:
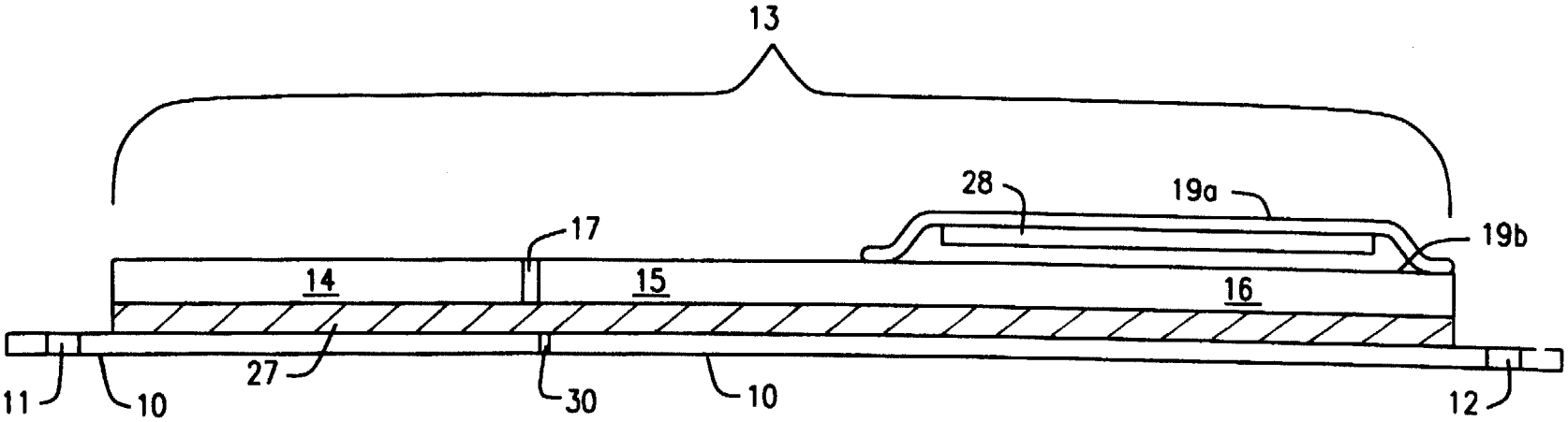
(PRIOR ART) FIG.2
FIG. 2 (prior art) is a side view of the label set form of FIG. 1.

FIG. 2 is a side view of the label shown in FIG. 1 and shows that each label set consists of a first label segment 14, a second label segment 15 and a third label segment 16, each having a permanent affixation adhesive layer 27 on the back thereof. The adhesive layer on the back of each label set is a permanent affixation adhesive, i.e., an adhesive which when exposed by removing the label carrying sheet 10 and applied to a container 20 or a case report form 21 will be permanently adherent thereto. The first label segment 14 and second label segment 15 are detachably connected to each other, with lines of dash-like perforations 17 between the first and second label segments allowing the first and second label segments to be separated from each other by tearing along the perforation lines 17. A cut 30 is made in the carrying sheet 10 to facilitate removal of the carrying sheet 10 under the first label segment 14 while leaving the carrying sheet 10 intact under the second label segment 15 and third label segment 16.

The first label segment 14 and second label segment 15 each consists of a single label portion, while the third label segment 16 has two label portions, namely (i) a cover portion 19*a* and (ii) an underlying data portion 19*b*. The cover portion 19*a* is applied, for example, by gluing the outer edges of the cover portion 19*a* to the underlying data portion 19*b* or by printing or otherwise applying the cover portion 19a over the underlying data portion 19b so that when the cover portion 19a is removed, the underlying data portion 19b is exposed to view.

The undersurface of the cover portion 19a may be covered with a layer of imaging or transfer substance 28, for example of the same type used to make "carbon" paper or noncarbon (sometimes called "carbonless") transfer paper, so that when sufficient pressure is applied by any means, for example, writing or typing, to the exposed surface of the cover portion 19a, a corresponding visible pattern is imprinted by the imaging or transfer substance 28 on the undersurface of the cover portion 19a onto the adjacent (hidden) surface of the underlying data portion 19b. A dotted outline 18 (see FIG. 1) is provided to outline the area of the imaging or transfer substance 28 on the undersurface of the cover portion 19a so that all information will be entered over the imaging or transfer substance 28 underlying the cover portion 19a to assure that all of the information will be transferred to the underlying data portion 19b by the imaging or transfer substance 28.

The cover portion 19a has a high density blockout of dark markings (not shown) on its exposed surface so that handwritten or computer printed material on the cover portion 19a cannot be read. This high density blockout also provides additional protection against anyone reading through the cover portion 19a. Thus, writing or printing on the exposed surface of the cover portion 19a results in a corresponding image being imprinted on the hidden surface of the underlying data portion 19b while the writing or printing on the exposed surface of the cover portion 19a is unreadable.

Alternatively, the exposed surface of the cover portion 19a may be covered by a separate outer cover sheet (not shown) which is removed, and either filed or discarded after being written or printed upon, so that no visible writing or printing appears on the surface of the cover portion 19a which is exposed when the outer cover sheet is removed.

After being placed on the label carrying sheet 10, the first, second, and third label segments 14, 15, and 16 are printed with indicia which are common to all of the drug tests to be conducted for a particular client. Examples of these indicia appear in FIG. 1, and may include, for example, instructions as to (i) bringing the container 20, to which the first label segment 14 will be later applied, to the patient's physician, (ii) affixing the second label segment 15 (and attached third label segment 16) to a case report form 21, (iii) opening the cover portion 19a of the third label segment 16 only in case of emergency, and other indicia.

The label carrying sheet 10 is then coupled to a printer (not shown) so that successive label sets 13 can be imprinted with (encoded or other) information identifying the particular drug test being conducted and the patient with whom the corresponding label set is associated. The label carrying sheet 10 can be advanced to the printer in a variety of ways, for example, by the engagement of tractor feed sprockets (not shown) with the sprocket holes 11 and 12 of the label carrying sheet 10 or by frictionally engaging the label carrying sheet 10.

A bottle or other container 20 contains either the drug to be tested or a placebo. A number of such containers is provided equal to the number of label sets printed, which in turn is equal to the number of visits each patient must incur multiplied by the number of patients participating in the drug test.

After the label sets 13 are imprinted with drug test and patient identifying information, the label sets 13 are detached one at a time from adjacent label sets 13 by tearing or cutting, manually or by machine, the carrying sheet 10 between label sets 13. Perforations 31 may be provided to assist in detaching adjacent label sets. This also entails separating the adjacent cover portions 19a of adjacent label sets 13 which are attached to each other in prior art label sets. The first label segment 14 of the label set is separated from the carrying sheet and permanently adhered to the container 20. The second label segment 15 and the attached third label segment 16 remain attached to the first label segment 14, and a corresponding portion of the carrying sheet 10, and are then wrapped around the bottle 20 by hand and held in place against the bottle 20 by a temporary attaching means, such as a rubber band or piece of tape. When the drug is eventually dispensed by a physician, the temporary attaching means is removed. The second and third label segments 15 and 16 are then unwrapped from the bottle 20, detached from the first segment 14 (which is permanently affixed to the bottle), and adhered to a case report form 21 for the patient.

The patient uses the drug or placebo within the container 20, while the patient's physician records medical information about the patient on the case report form 21. When the test is completed the physician returns the case report form to the administrator of the drug test so that the effects of the drug (or placebo) on the patient can be evaluated.

If patients suffer adverse medical effects during the period of the test it is essential that their physician be able to immediately determine whether the patient has been taking the drug or a placebo, so that the physician can diagnose the patient's condition and ascertain what treatment is appropriate. Should such an emergency occur, the physician removes the cover portion 19a of the third label segment 16 and reads the information imprinted on the (now exposed) underlying data portion 19b to determine whether the drug or a placebo was given to the patient. When the case report form is returned to the entity conducting the test the administrator of the test will note that the data portion 19b, has been exposed because the cover portion 19a cannot be re-attached. Thus, the administrator will know that the corresponding patient's physician was aware of whether the patient was given the drug or a placebo. This information can be taken into consideration in evaluating the results of the test.

While the aforementioned prior art arrangement provides an otherwise satisfactory system for testing drugs, it requires:

(1) Detaching, either manually or by machine, the adjacent label sets and their attached underlying carrying sheet from each other (which also entails separating the cover portions of adjacent label sets which are attached to each other);

(2) manually stripping the waxy carrying sheet from the first label segment to expose the permanent adhesive;

(3) applying the first label segment to the corresponding container;

(4) temporarily securing the second and third label segments to the container with a temporary securing means, using for example a rubber band or a piece of tape, to temporarily hold the second and third label segments in place;

(5) removing the temporary securing means;

(6) separating the second and third label segments from the first segment;

(7) stripping the waxy carrying sheet off of the back of the second and third label segments to expose the permanent affixation adhesive; and (8) attaching the second and third label segments to a case report.

This is a tedious, time-consuming, and expensive process in most drug tests where hundreds and often thousands of patients can be involved.

DETAILED DESCRIPTION OF A PREFERRED EMBODIMENT OF THE INVENTION

In FIGS. 3, 4, 5, and 6, those elements which correspond to elements of FIGS. 1 and 2 have the same numerals followed by the letter "all—except for elements 19a' and 19b' which correspond to elements 19a and 19b of FIG. 1 respectively.

Figure 3:
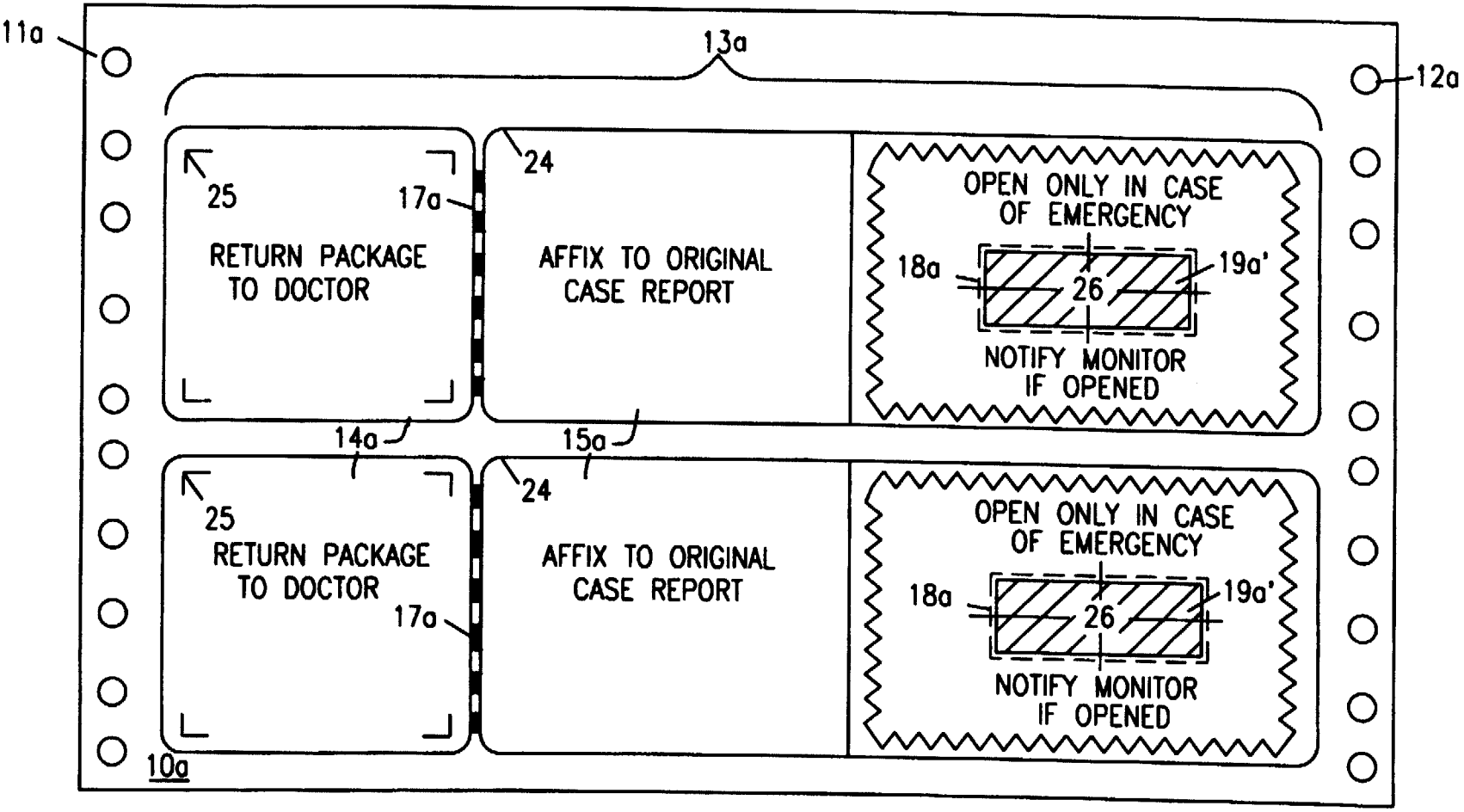
FIG. 3 shows a three-part label set form for use in drug testing according to a preferred embodiment of the present invention.
Figure 4:
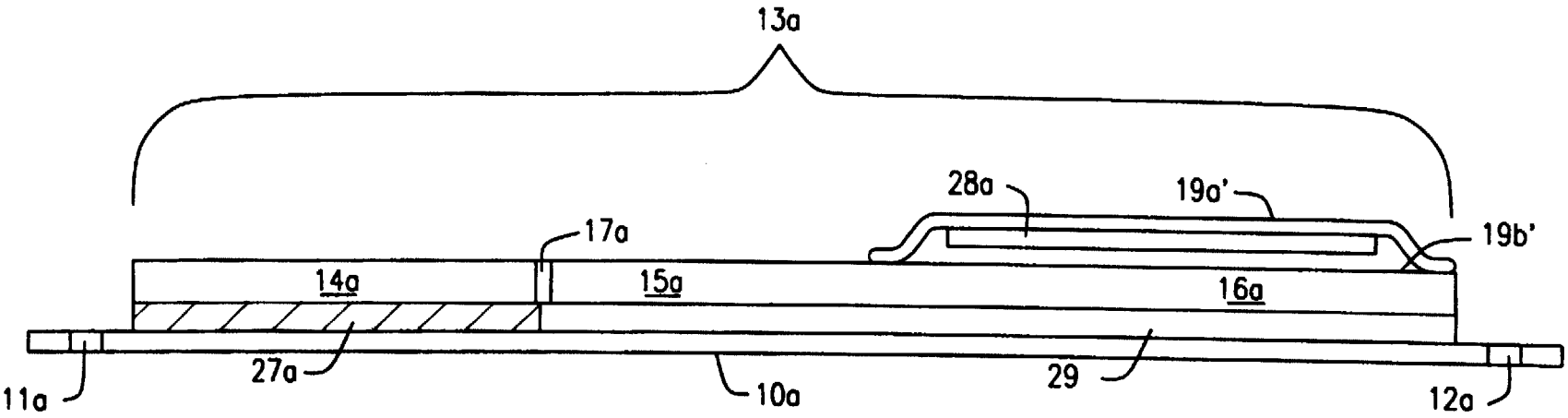
FIG. 4 is a side view of the label set form of FIG. 3.

FIG. 3 is a top view of a label set form of the invention and shows a label carrying sheet 10a which is similar to the label carrying sheet 10 used in the prior art arrangement of FIG. 1 except that the only perforations in carrying sheet 10a are sprocket holes 11a and 12a. The label sets 13a of FIG. 3 generally correspond with the label sets 13 of FIG. 1, except i that whereas all three label segments of the label set 13 are provided with a permanent affixation adhesive 27, only the first label segment 14a of the label set 13a is provided with such a permanent affixation adhesive 27a—the second and third label segments 15a and 16a being provided with a temporary affixation adhesive 29 (as shown in FIG. 4 which is a side view of the label shown in FIG. 3). In addition, whereas the cover portion 19a covering prior art third label segments 16 are connected to adjacent cover portions 19a, the cover portions 19a', of the third label segments 16a' in accordance with the invention are separated from the cover portions 19a' of adjacent label sets 13a so that each of the label sets 13a is disposed separate and apart from adjacent label sets 13a on the label carrying sheet 10a.

The first and second segments 14a and 15a each consist of a single label portion, while the third segment 16a has two label portions, namely (i) a cover portion 19a' and (ii) an underlying data portion 19b'. The cover portion 19a' is applied, for example, by gluing the outer edges of the cover portion 19a' to the underlying data portion 19b' or by printing the cover portion on the underlying data portion 19b' so that when the cover portion 19a' is removed, the underlying data portion 19b' is exposed to view.

The temporary affixation adhesive 29 on the backs of the second and third segments 15a and 16a is an adhesive which enables these segments to be removed from and then re-adhered to various surfaces, including glass, paper and plastic. Such an adhesive is similar to those well known in the art, e.g., the temporary adhesive widely used on the Post-It™" notes sold by 3M Company.

V-Cut cusps or notches 24 are disposed between the first label segment 14a and the second label segment 15a and are located at each end of the dash-like perforations 17a to facilitate removal of the second label segment 15a and third label segment 16a from the first label segment 14a. These cusps or notches 24 also provide for a neater finish of the labels if the remaining corners are cut in the same pattern. Another advantage of these cusps or notches 24 is that their rounded edges are less likely to be caught and lifted than a right angle corner.

Tamper evident slits 25 (FIG. 3) are cut into the first label segment 14a. Because the first label segment 14a is attached to a container 20a with a permanent affixation adhesive 27a, if any attempt is made to tamper with the first label segment 14a tamper evident slits 25 will tear providing evidence of the tamper.

Tamper evident slits 26 (FIG. 3) are cut into removable cover portion 19a' of the third label segment 16a) if an attempt is made to remove the cover portion 19a', or read the information on underlying data portion 19b', the tamper evident slits 26 will tear providing evidence of the tamper.

The label sets 13a are printed (while on the label carrying sheet 10a) with indicia similar to the indicia preprinted on the label sets 13. The label carrying sheet 10a is coupled to a printer (not shown) so that successive label sets 13a can be imprinted with (i) (encoded or other) information identifying the particular drug test being conducted and the patient with whom the corresponding label set is associated, and (ii) hidden information on the underlying data portion, 19b' on the third segment 16a. The label carrying sheet 10a can be advanced to the printer in a variety of ways, for example, by the engagement of tractor feed sprockets (not shown) with the sprocket holes 11a and 12a of the label carrying sheet 10a or by frictionally engaging the label carrying sheet 10a.

The underlying data portion 19b' on the third label segment 16a of each label set is imprinted by the aforementioned printer with hidden information as to whether the particular label set 13a relates to a drug or a placebo—and if a drug, information can be imprinted as to what immediate steps to take in the event of an adverse reaction. Thus, some carrying sheets 10a can have all the label sets 13a thereon imprinted to reflect the drug being tested, while other carrying sheets 10a can have all the label sets thereon imprinted to reflect the use of a placebo.

Figure 6:
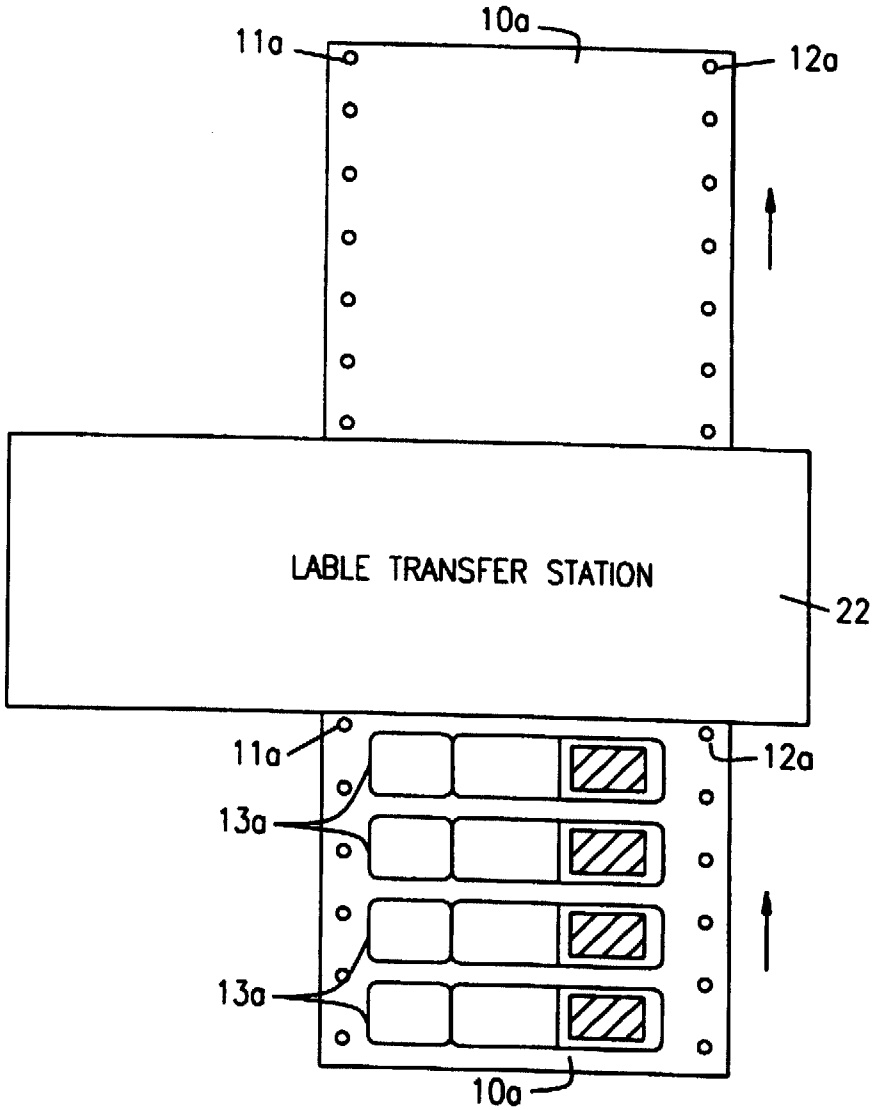
FIG. 6 shows an arrangement for applying the label set form shown in FIGS. 3, 4, and 5 to containers, according to a preferred embodiment of the present invention.
Figure 6:
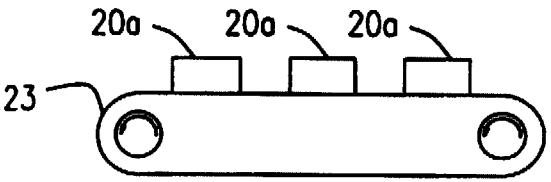

Machines for removing labels from a label carrying sheet similar to the sheet 10a and for applying them to bottles or other containers are well known in the packaging art. After printing of the aforementioned information on the label sets 13a disposed on the carrying sheet 10a, the carrying sheet 10a is advanced toward a label transfer station. The label transfer station may be a station where the transfer of the label sets 13a to containers 20a is executed manually or may be executed by an automated transfer station 22 as shown in FIG. 6.

At the label transfer station 22 each label set 13a is removed from the label carrying sheet 10a and the entire label set 13a (not just the first label segment 14a) is applied to a corresponding container 20a. The label set 13a is applied to the container 20a in such a way that the first label segment 14a permanently adheres to the container and the second and third label segments 15a and 16a temporarily adhere to the container 20a. The second label segment 15a and third label segment 16a may have some portions which adhere to the container and other portions which overlap and adhere to the first label segment 13a depending upon the dimensions of the container to which the label set is attached.

Since the first label segment 14a has a permanent affixation adhesive layer 27a, it becomes permanently adherent to the container 20a. However, since the second and third label segments, 15a and 16a, have temporary affixation adhesive layers 29, they are only temporarily adherent to the container 20a and/or the first label segment 14a, and can be easily removed therefrom.

Each label set-wrapped container 20a emerges from the label transfer station 22 and is dumped onto a conveyer 23 for transportation to a collection area (not shown) where the containers are placed in boxes or other packages.

Figure 5:
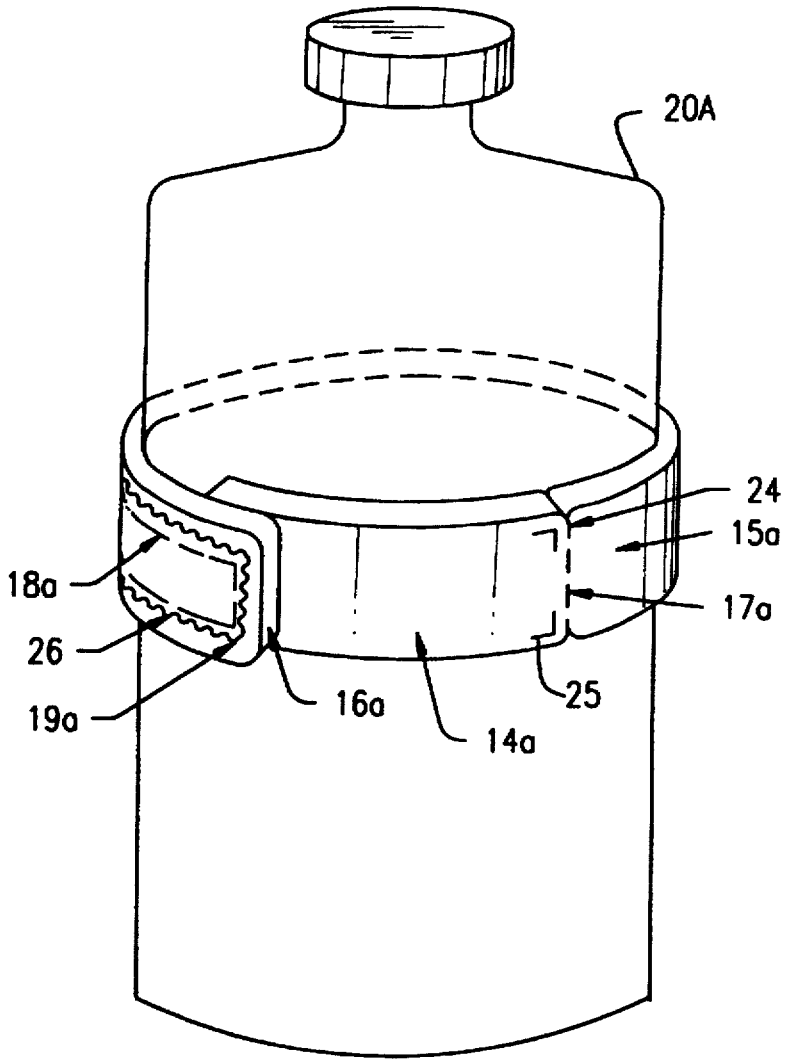
FIG. 5 shows the three part label set form of FIGS. 3 and 4 applied to a container.

FIG. 5 shows the resulting configuration of the container 20a and label segments 14a, 15a and 16a after applying label set 13a to a container 20a. In this form the label set-wrapped containers 20a are delivered to the physicians of the patients participating in the test. When the container 20a and its contents is dispensed to a patient by a physician, each physician or someone in his employ removes the second and third label segments 15a and 16a from the container 20a and applies them to a case report form 21 corresponding to that patient.

The net result of the use of the aforementioned label form and the method described above is a properly labelled container and a properly labelled corresponding case report form with many advantages over the prior art. Among its many advantages, Applicants, invention allows the second and third label segments to be temporarily adhered to a container with a temporary adhesive rather than being temporarily held in place, for example, by a rubber band or a piece of tape. The second and third label segments can then be easily removed from the container and attached to a case report form by the same temporary adhesive that was used to temporarily adhere the second and third label segments to the container.

Figure 7:
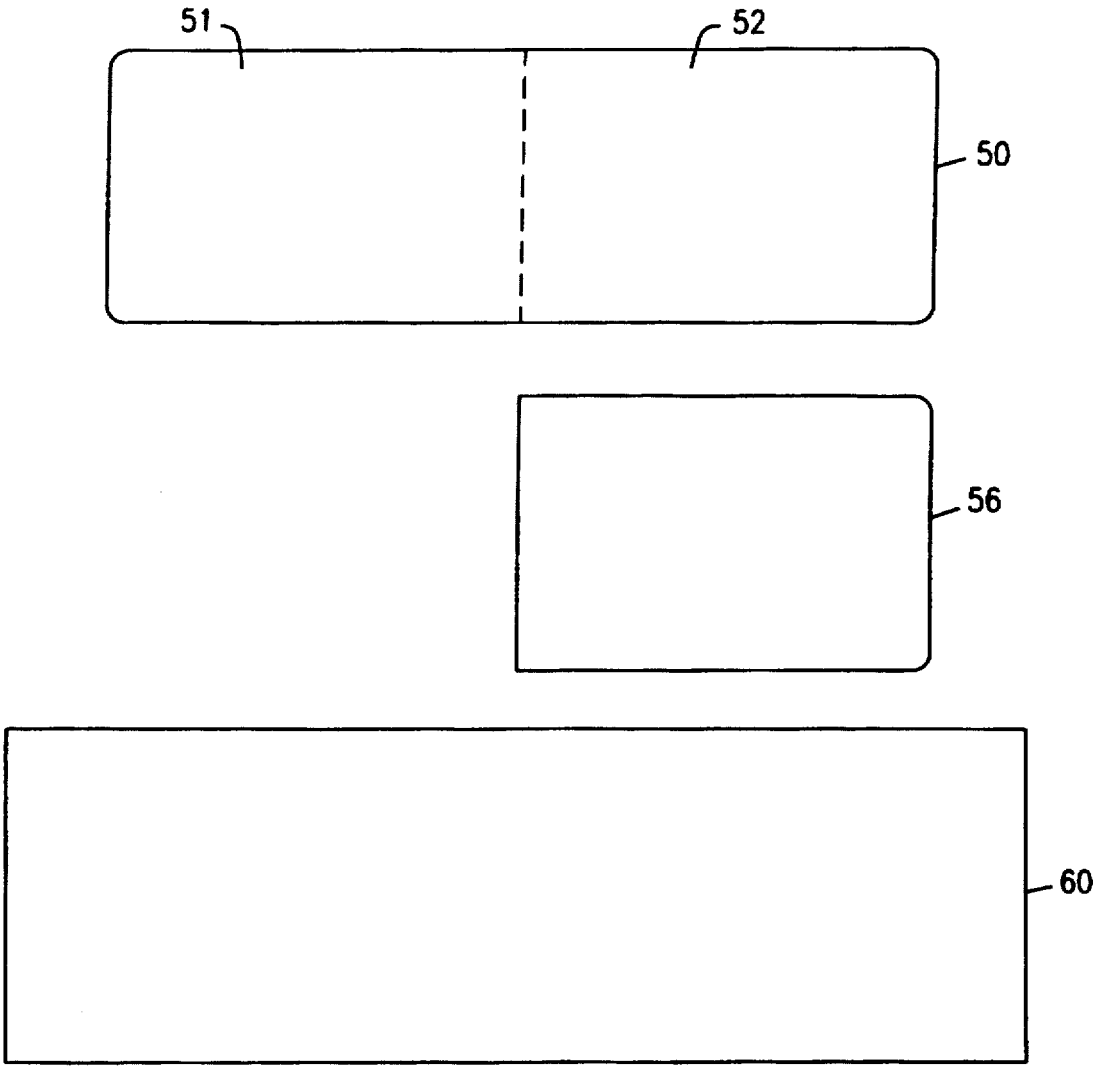
FIG. 7 is a top view of the components of an alternative embodiment of the invention.
Figure 8:
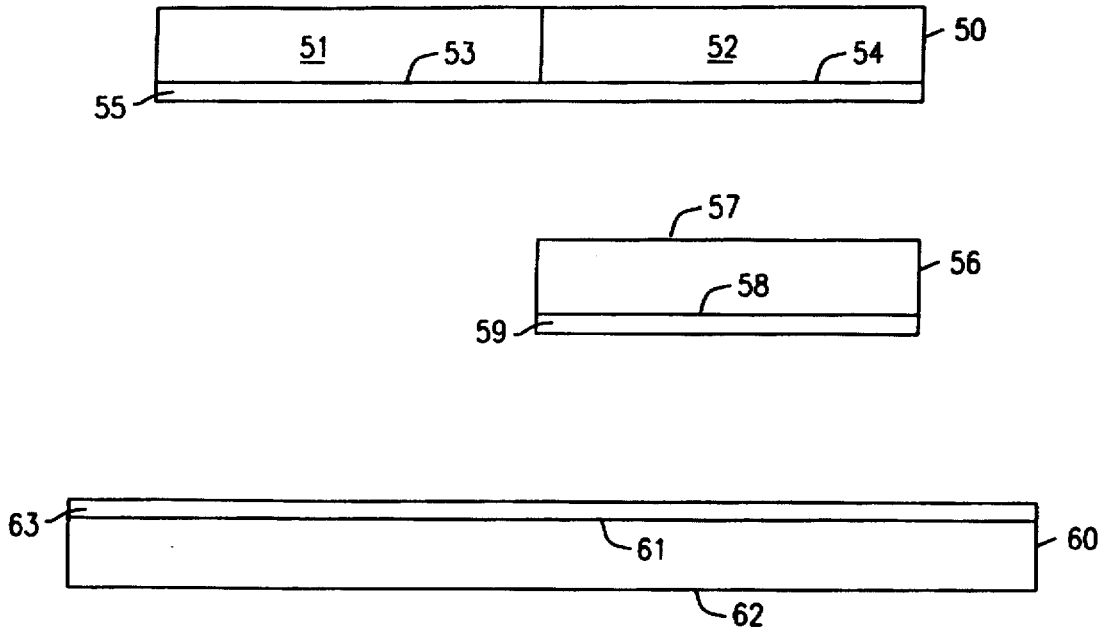
FIG. 8 is a side view of the components of the embodiment shown in FIG. 7 shown prior to assembly.
Figure 9:
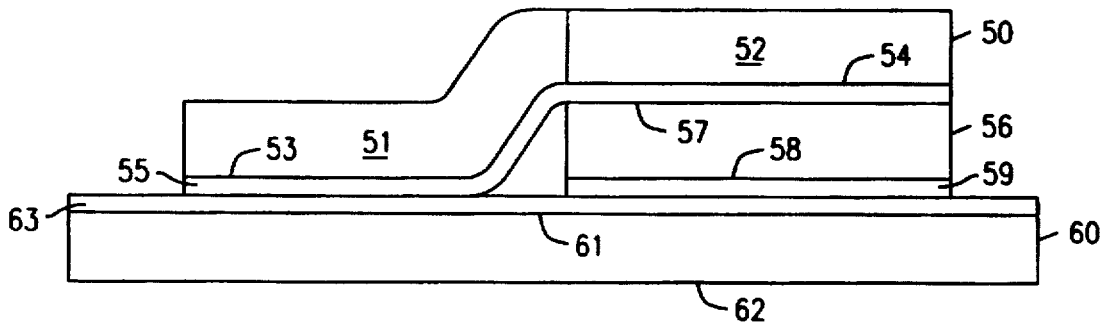
FIG. 9 is a side view of the embodiment shown in FIG. 8 shown after assembly.

FIGS. 7, 8, and 9 show an especially preferred embodiment of the invention. As shown in FIGS. 7, 8, and 9, the label 50 has a first segment 51 and a second segment 52. Major surface 53 of first label segment 51 and major surface 54 of label segment 52 are provided with a permanent adhesive 55, as shown in FIG. 8. A mounting sheet 56 having a first major surface 57 and a second major surface 58 is provided with a removable adhesive 59 on second major surface 58. In a preferred embodiment, the mounting sheet 56 is made from a clear polyester. In a especially preferred embodiment, the polyester is Mylar® available from DuPont. Carrying sheet 60 has a first major surface 61 and a second major surface 62. A non-stick coating 63 is applied to first major surface 61 of carrying sheet 60. In a preferred embodiment, silicone is utilized. As shown in FIGS. 8 and 9, mounting sheet 56 is sandwiched between the label 50 and the carrying sheet 60. First surface 57 of the mounting sheet 56 is aligned with the permanent adhesive 55 attached to major surface 54 of second label portion 52. The removable adhesive 59 attached to second major surface 58 of mounting sheet 56 and the permanent adhesive 55 on second major surface 53 of first label segment 50 are aligned and brought into contact with the non-stick coating 63 on major surface 61 of carrying sheet 60 as shown in FIG. 9.

Figure 10:
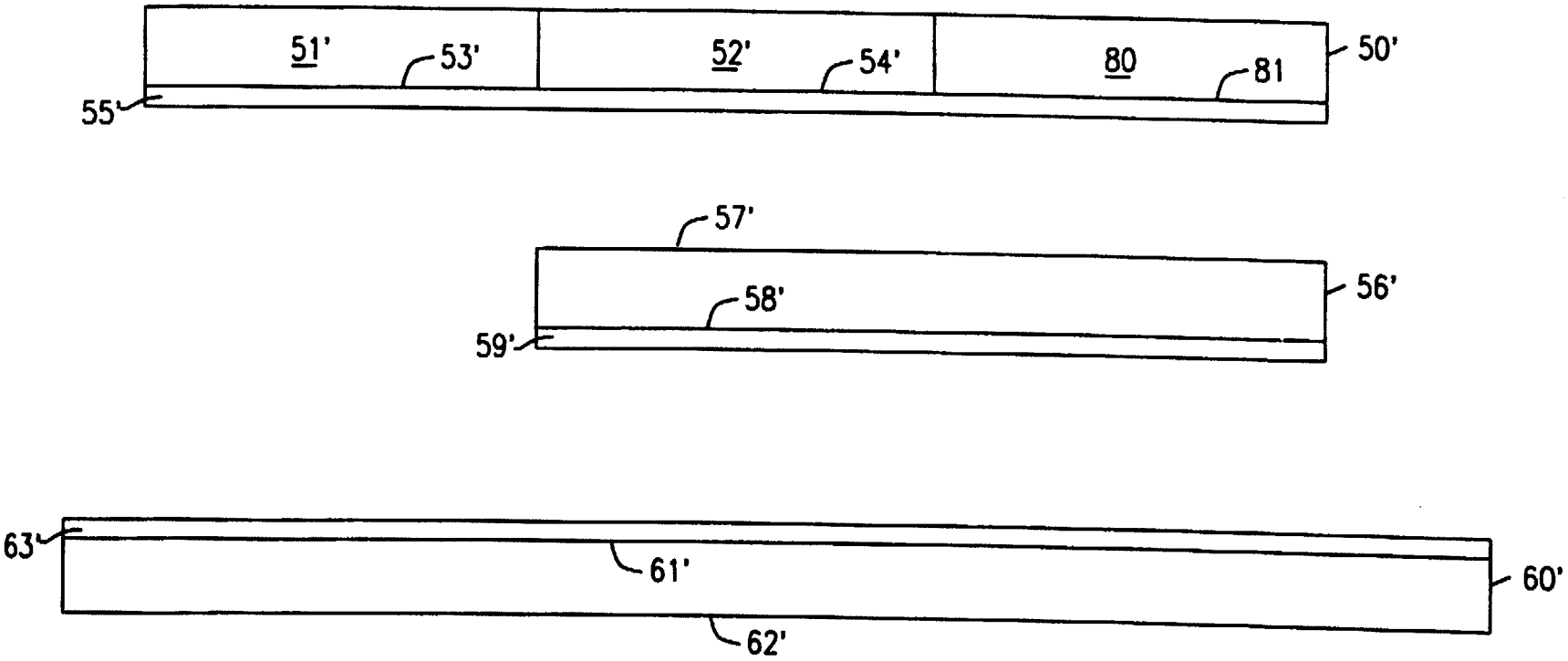
FIG. 10 shows the embodiment of the invention shown in FIGS. 7–9 applied to a three-segment label shown after assembly.

FIG. 10 shows another preferred embodiment of the invention shown in FIGS. 7–9 applied to an assembled three-segment label. As shown in FIG. 10, the label 50' has a first segment 51', a second segment 52', and a third segment 80. Major surface 53' of first label segment 51', major surface 54' of second label segment 52', and major surface 81 of third label segment 80 are provided with a permanent adhesive 55'. Mounting sheet 56' having a first major surface 57' and a second major surface 58' is provided with a removable adhesive 59' on second major surface 58'. Carrying sheet 60' has a first major surface 61' and a second major surface 62'. A non-stick coating 63' is applied to first major surface 61' of carrying sheet 60'. Mounting Sheet 56' is sandwiched between the label 50' and the carrying sheet 60'. First surface 57' of the mounting sheet 56' is aligned with the permanent adhesive 55' attached to major surface 54' of second label portion 52' and major surface 81 of third label segment 80. The removable adhesive 59' attached to second major surface 58' of mounting sheet 56' and the permanent adhesive 55' on second major surface 53' of first label segment 50' are aligned and brought into contact with the non-stick coating 63' on major surface 61' of carrying sheet 60' as previously discussed. The label segments may be marked to contain hidden information as previously discussed.

Figure 11:
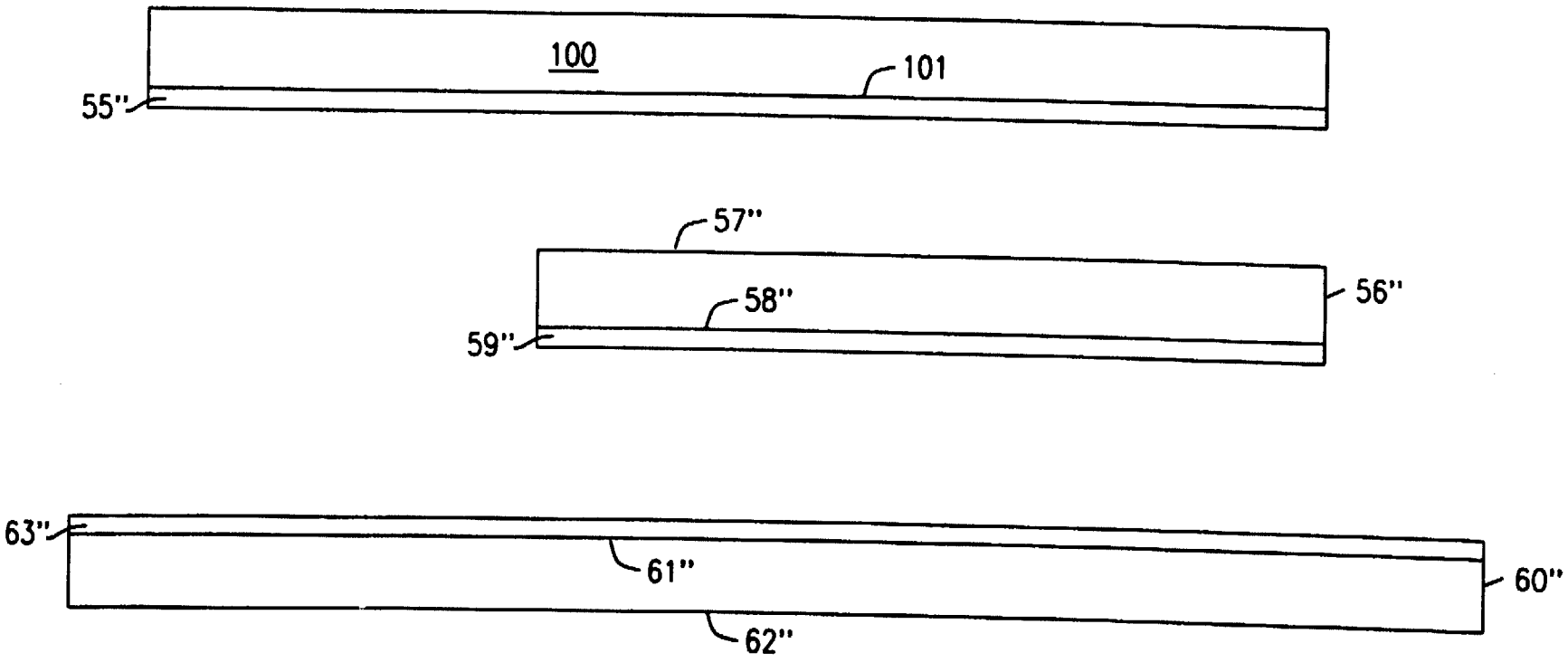
FIG. 11 shows an alternative embodiment of a label constructed in accordance with the invention.

FIG. 11 shows another especially preferred embodiment of the invention which allows the label to wrap around itself on a container, e.g., a cylindrical container as shown in FIG. 5. As shown in FIG. 11, major surface 101 of label 100 is provided with a permanent adhesive 55". Mounting sheet 56" having a first major surface 57" and a second major surface 58" is provided with a removable adhesive 59" on second major surface 58". Carrying sheet 60" has a first major surface 61" and a second major surface 62". A non-stick coating 63" is applied to first major surface 61" of carrying sheet 60". Mounting Sheet 56" is sandwiched between the label 50" and the carrying sheet 60". First surface 57" of the mounting sheet 56' is aligned with the permanent adhesive 55" attached to major surface 101 of the label 100. The removable adhesive 59" attached to second major surface 58" of mounting sheet 56" and the permanent adhesive 55" on major surface 101 of the label 100 are aligned and brought into contact with the non-stick coating 63" on major surface 61" of carrying sheet 60" as previously discussed. The label may be marked to contain hidden information as previously discussed. The removable adhesive 59" allows the label 100 to selectively and removably be wrapped around itself on a container, as shown in FIG. 5, without damaging the label or the indicia on it.

These differences between the label form according to a preferred embodiment of the present invention and the label form according to the prior art allow for a more stable label and faster, more efficient, more uniform, and less expensive manual or automated application of the label sets to corresponding containers.

What is claimed is:

1. A multi-segment label form comprising: an elongated label carrying sheet said sheet having a non-stick surface for detachably receiving label sets comprising label segments having self-adhering adhesive coatings thereon; and a plurality of adjacent label sets disposed on said label carrying sheet and detachably adhered thereto without being attached to each other, each label set including a first label segment having a permanent affixation adhesive layer on a major surface, a second label segment adjacent and detachably attached to said first label segment, said second label segment having a permanent affixation adhesive layer on a major surface, and a mounting sheet having a first major surface and a second major surface, said second major surface provided with a temporary affixation adhesive layer, said first major surface of said mounting sheet attached to said permanent affixation adhesive on said second label segment, a third label segment adjacent and attached to said second label segment, said third label segment having a removable cover portion and an underlying data portion having one major surface adapted to receive indicia that is unreadable until said removable cover portion is removed, said data portion having a permanent affixation adhesive layer on its opposite major surface, a mounting sheet having a first major surface and a second major surface, said second major surface provided with a temporary affixation adhesive layer, said first major surface of said mounting sheet attached to said permanent affixation adhesive on said third label segment, a line of perforations between said first label segment and said second label segment to facilitate the detachment of said first label segment from said second label segment.

2. The label form of claim 1 further comprising tear facilitation notches disposed at the ends of said line of perforations between said first label segment and said second label segment.

3. The label form of claim 1 further comprising tamper evident slits cut into said first label segment.

4. The label form of claim 1 wherein said removable cover portion is paper.

5. The label form of claim 4 further comprising tamper evident slits cut into said removable cover portion.

6. The label form according to claim 1, wherein said label carrying sheet has sprocket holes disposed adjacent the longitudinal sides thereof.

7. A multi-segment label form for use in drug testing, comprising:

an elongated label carrying sheet said sheet having a non-stick surface for detachably receiving label sets comprising label segments having self-adhering adhesive coatings thereon; and a plurality of adjacent label sets disposed on said label carrying sheet and detachably adhered thereto without being attached to each other, each label set including a first label segment having a permanent affixation adhesive layer on a major surface, a second label segment adjacent and detachably connected to said first label segment, said second label segment having a permanent affixation adhesive layer on a major surface, a mounting sheet having a first major surface and a second major surface, said second major surface provided with a temporary affixation adhesive layer, said first major surface of said mounting sheet attached to said permanent affixation adhesive on said second label segment, a line of perforations between said first label segment and said second label segment to facilitate the detachment of said first label segment from said second label segment.

8. The label form of claim 7 further comprising tear facilitation notches disposed at the ends of said line of perforations between said first label segment and said second label segment.

9. The label form of claim 7 further comprising tamper evident slits cut into said first label segment.

10. The label form according to claim 7, wherein said label carrying sheet has sprocket holes disposed adjacent the longitudinal sides thereof.

11. A multi-segment label form for use in drug testing, comprising:

an elongated label carrying sheet said sheet having a non-stick surface for detachably receiving label sets comprising label segments having self-adhering adhesive coatings thereon; and a plurality of adjacent label sets disposed on said label carrying sheet and detachably adhered thereto without being attached to each other, each label set including a first label segment having a permanent affixation adhesive layer on a major surface, a second label segment adjacent and detachably attached to said first label segment, said second label segment having a removable cover portion and an underlying data portion having one major surface adapted to receive indicia that is unreadable until said removable cover portion is removed, said data portion having a permanent affixation adhesive layer on the opposite major surface, a mounting sheet having a first major surface and a second major surface, said second major surface provided with a temporary affixation adhesive layer, said first major surface of said mounting sheet attached to said permanent affixation adhesive on said second label segment, a third label segment adjacent and attached to said second label segment, said third label segment having a permanent affixation adhesive layer on a major surface, a mounting sheet having a first major surface and a second major surface, said second major surface provided with a temporary affixation adhesive layer, said first major surface of said mounting sheet attached to said permanent affixation adhesive on said third label segment, a line of perforations between said first label segment and said second label segment to facilitate the detachment of said first label segment from said second label segment.

12. The label form of claim 11 further comprising tear facilitation notches disposed at the ends of said line of perforations between said first label segment and said second label segment.

13. The label form of claim 11 further comprising tamper evident slits cut into said first label segment.

14. The label form of claim 11 wherein said removable cover portion is paper.

15. The label form of claim 11 further comprising tamper evident slits cut into said removable cover portion.

16. The label form according to claim 11, wherein said label carrying sheet has sprocket holes disposed adjacent the longitudinal sides thereof.

17. A method for applying a plurality of label sets to corresponding containers so that a first label segment of a label set is applied to a container and second and third label segment of said label set are applied to a corresponding case report document for drug testing purposes comprising the steps of:

a) providing a major surface of said first label segment of each label set with a permanent affixation adhesive layer;

b) providing a major surface of said second and said third label segments of each label set with a permanent affixation adhesive layer;

c) providing a mounting sheet having a first major surface and a second major surface, said second major surface provided with a temporary affixation adhesive layer;

d) attaching said first major surface of said mounting sheet to said permanent affixation adhesive on said second and said third label segments, e) detachably adhering said first, said second, and said third label segments of a plurality of label sets to an elongated label carrying sheet so that said label sets are adjacent to and not attached to each other;

f) advancing said label carrying sheet in the longitudinal direction thereof to a label transfer station; and g) detaching each label set from said label carrying sheet at said label transfer station, and (i) applying said first label segment to said container to permanently adhere said first label segment to said container, and (ii) applying said second and said third label segments to said container to temporarily and detachably adhere said second and said third label segments to said container.

18. The method of claim 17 in which step e) is performed manually.

19. The method of claim 17 in which step e) is performed by automated machinery.

20. The method according to claim 17, comprising the additional steps of:

f) removing said second and said third label segments from said container;

g) detaching said second and said third label segments from said first label segment; and h) applying said second and said third label segments to said corresponding case report document.

21. A method for applying a plurality of label sets to corresponding containers so that a first label segment of each label set is applied to a container and a second label segment of said label set is applied to a corresponding case report document for drug testing purposes comprising the steps of:

a) providing a major surface of said first label segment of each label set with a permanent affixation adhesive layer;

b) providing a major surface of said second label segment of each label set with a permanent affixation adhesive layer;

c) providing a mounting sheet having a first major surface and a second major surface, said second major surface provided with a temporary affixation adhesive layer;

d) attaching said first major surface of said mounting sheet to said permanent affixation adhesive on said second label segment, e) detachably adhering said first and said second label segments of a plurality of label sets to an elongated label carrying sheet so that said label sets are adjacent to and not attached to each other;

f) advancing said label carrying sheet in the longitudinal direction thereof to a label transfer station; and g) detaching each label set from said label carrying sheet at said label transfer station, and (i) applying said first label segment to said container to permanently adhere said first label segment to said container, and (ii) applying said second label segment to said container to temporarily and detachably adhere said second label segment to said container.

22. The method of claim 21 in which step e) is performed manually.

23. The method of claim 21 in which step e) is performed by automated machinery.

24. The method according to claim 21, comprising the additional step of:

f) removing said second label segment from said container;

g) detaching said second label segment from said first label segment; and h) applying said second label segment to said corresponding case report document.

25. A label form for use in drug testing, comprising:

an elongated label carrying sheet said sheet having a non-stick surface for detachably receiving labels having self-adhering adhesive coatings thereon; and a plurality of adjacent labels disposed on said label carrying sheet and detachably adhered thereto without being attached to each other, each label including:

a label having a permanent affixation adhesive layer on a major surface, a mounting sheet having a first major surface and a second major surface, said second major surface provided with a temporary affixation adhesive layer, said first major surface of said mounting sheet sized and attached to said permanent affixation adhesive on said label segment so as to cover less than the entire surface of said permanent affixation adhesive layer to leave a portion of said permanent affixation adhesive exposed.

26. The label form of claim 25 further comprising tamper evident slits cut into said label.

27. The label form according to claim 25, wherein said label carrying sheet has sprocket holes disposed adjacent the longitudinal sides thereof.

28. The label of claims 1, 7, 11, 17, 21, or 25, wherein said non-stick surface is silicone.

29. The label of claims 1, 7, 11, 17, 21, or 25, wherein said mounting sheet is polyester.

* * * * *